US006486791B1

(12) United States Patent
Crawford

(10) Patent No.: US 6,486,791 B1
(45) Date of Patent: Nov. 26, 2002

(54) DRIVING A VISUAL INDICATOR ARRAY IN AN ELECTRONIC SIGNALING SYSTEM

(75) Inventor: Eric Crawford, Sacramento, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/872,490

(22) Filed: May 31, 2001

(51) Int. Cl.[7] ..... G09F 9/33
(52) U.S. Cl. ..... 340/815.45; 340/458; 362/800
(58) Field of Search ..... 340/458, 815.4, 340/815.45; 362/800

(56) References Cited

U.S. PATENT DOCUMENTS 4,065,716 A * 12/1977 O'Brien
4,682,147 A * 7/1987 Browman
5,585,783 A * 12/1996 Hall ..... 340/815.45
5,783,909 A * 7/1998 Hochstein ..... 315/159
6,225,912 B1 * 5/2001 Tanaka et al. ..... 340/815.45
6,271,815 B1 * 8/2001 Yang et al. ..... 340/815.45

* cited by examiner

*Primary Examiner*—Daniel J. Wu
(74) *Attorney, Agent, or Firm*—Fish & Richardson P.C.

(57) ABSTRACT

Status information is provided from an electronic signaling system to an array of N light emitting diodes (LEDs) connected in series between high and low voltage sources, where N≧2, and where N is selected so that the potential difference between the voltage sources is less than the sum of the cut-in voltages of the N LEDs in the array. Control signals are delivered from the electronic signaling system to the LED array over M control lines (N>M≧1), each of which is connected between two of the LEDs in the array. The control signals cause the LEDs to conduct. The control signals are timed so that the LEDs in the array conduct one or two at a time.

16 Claims, 3 Drawing Sheets

| LED ON | CONTROL STATE |
|---|---|
| ALL OFF | (Z, Z) |
| 1 | (0, Z) |
| 2 | (1, 0) |
| 3 | (Z, 1) |
| 1 & 2 | (Z, 0) |
| 1 & 3 | (0, 1) |
| 2 & 3 | (1, Z) |

UNUSED STATES: (0, 0), (1, 1)

FIG. 4

DRIVING A VISUAL INDICATOR ARRAY IN AN ELECTRONIC SIGNALING SYSTEM

TECHNICAL FIELD

This application relates to electronic signaling and, more particularly, to driving a visual status indicator array in an electronic signaling system, such as those found in network repeaters and switches.

BACKGROUND

Many computer networks rely on network repeaters and switches to facilitate the exchange of information among the computers in the network. In many networks, such as Ethernet networks, information is exchanged in the form of data packets that pass through each of the repeaters or switches in the network. The repeaters or switches usually monitor the data packets to collect information on the status of network resources. Network administrators then use the status information to manage the network resources.

One way of conveying the status information from a repeater to a network administrator is through visual indicators, such as an array of light emitting diodes (LEDs). In many cases, each LED in the array is dedicated to presenting information about a particular status condition on a particular repeater port. The network administrator can determine whether a particular status condition exists on a repeater port by observing whether the corresponding LED in the array is illuminated. One problem with this technique is that additional pins must be added to the repeater chip to deliver status signals to the LED array, thus driving up the cost and complexity of the repeater chip.

Sophisticated techniques have been developed to reduce the number of signal lines required to drive an LED indicator array in a network repeater. In one such technique, a 16×5 array of LEDs provides information about five status conditions for each of sixteen repeater ports. The LED array is driven by eight time-multiplexed signals, each of which carries information about all five status conditions for two of the sixteen repeater ports. While this technique for driving the LED array succeeds in placing a great deal of information on very few status lines, the technique requires a relatively sophisticated multiplexing circuit in the repeater chip and an equally sophisticated demultiplexing scheme at the LED array. This technique is much more suited for use with large LED arrays than it is for small arrays, such as a 4×4 or a 6×3 array.

DESCRIPTION OF DRAWINGS

FIG. 4 is a table showing the operation of the control circuitry of FIG. 3.

Like reference numbers and designations in the various drawings indicate like elements.

Like reference symbols in the various drawings indicate like elements.

DETAILED DESCRIPTION

Figure 1:
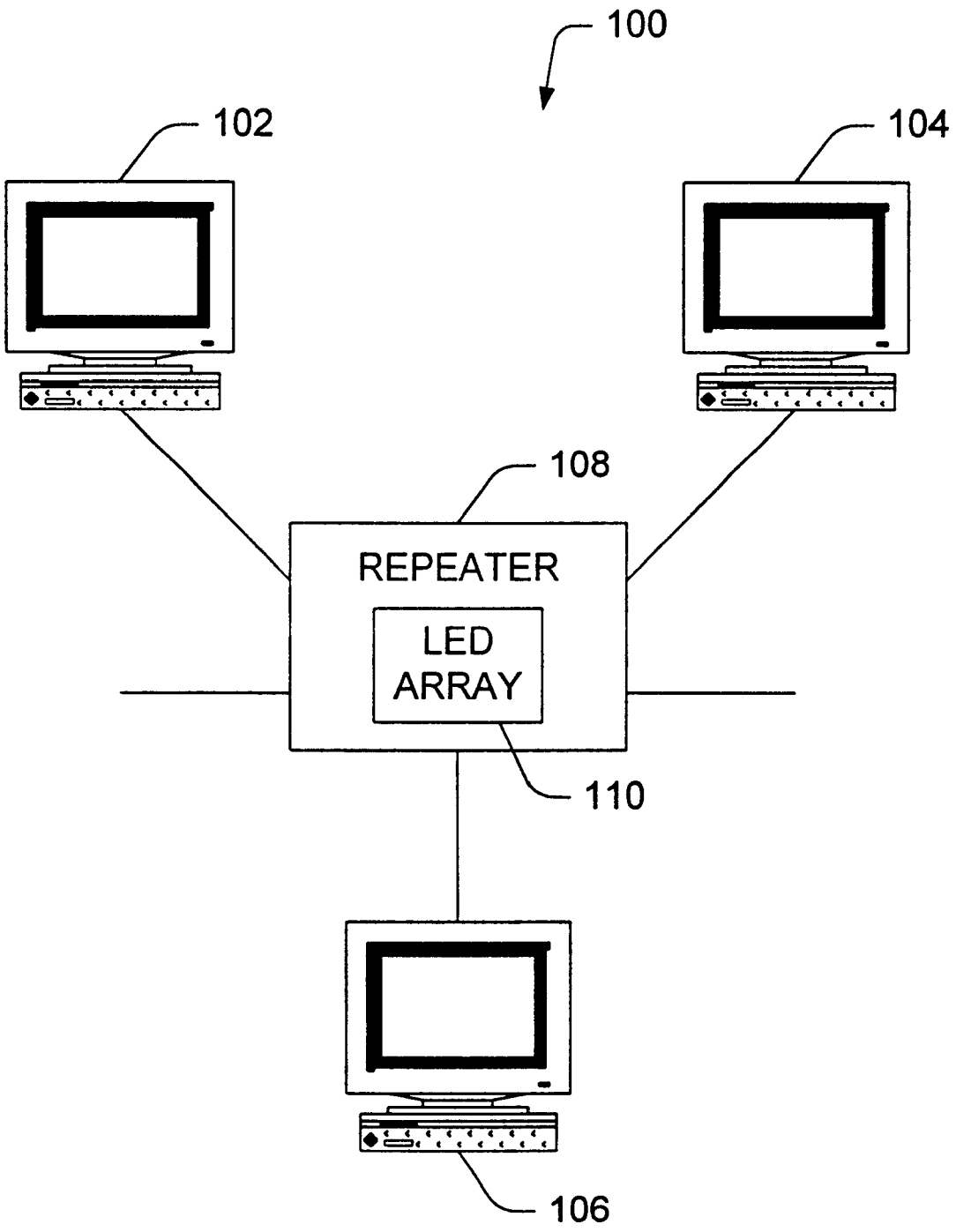
FIG. 1 is schematic diagram of a computer network with several workstations connected to a repeater.

FIG. 1 shows a computer network 100 in which several computers 102, 104, 106 are connected to a repeater or switch 108. The repeater 108 includes multiple ports, at least one of which receives data packets from the computers 102, 104, 106, and at least one of which distributes the data packets throughout the network 100. The repeater 108 also includes, or is linked to, a visual display 110, such as an LED array, that provides a visual indication of various status conditions monitored by the repeater 108. In general, the visual display 110 responds to status information collected by the repeater 108 from the data packets. The repeater 108 usually collects information about one or more particular status conditions for each of the ports through which data packets travel. For example, a particular repeater might monitor six status conditions for each of six repeater ports, thus producing 36 separate status conditions. In most cases, each of these status conditions has a corresponding LED in the indicator array. Examples of the types of status conditions monitored for individual ports include the standard LINK, PARTITION, ISOLATE, PORT ENABLED, and COLLISION conditions. In some cases, the repeater also monitors status conditions that do not apply to particular ports, but rather apply to the repeater as a whole. Examples of conditions monitored for the repeater as a whole include the RPS FAULT, GLOBAL SECURITY, GLOBAL FAULT, and GLOBAL COLLISION conditions.

Figure 2:
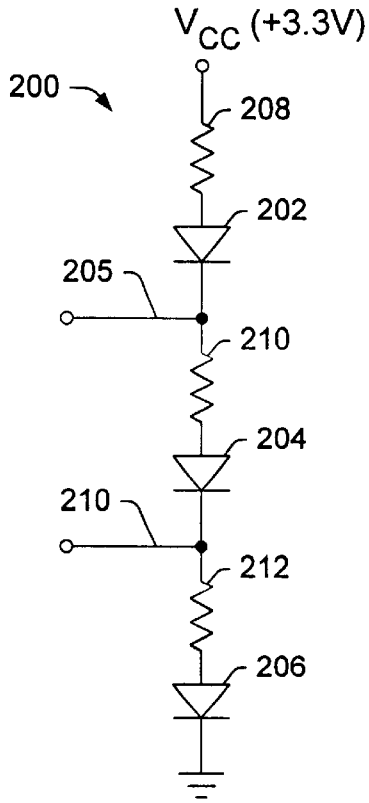
FIG. 2 is a schematic diagram of a status indicator array.
Figure 3:
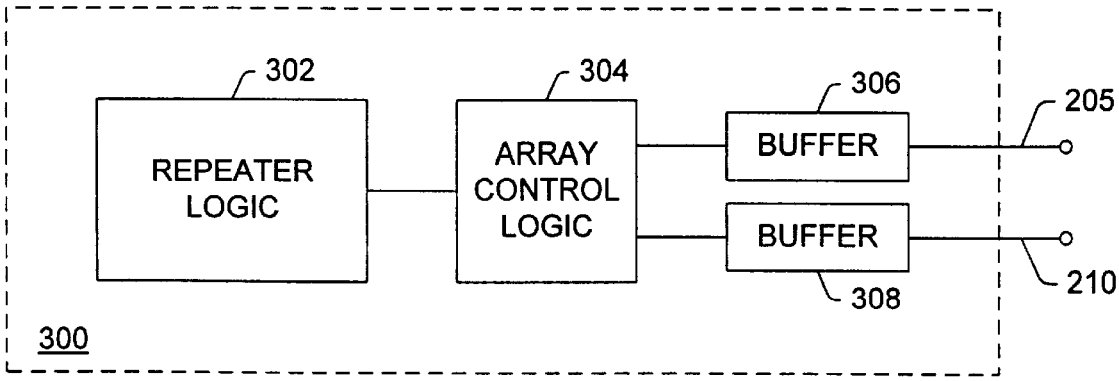
FIG. 3 is a block diagram of a network repeater chip with circuitry to drive the indicator array of FIG. 2.

FIGS. 2 and 3 show a simple LED array 200 and repeater structure 300, respectively, that allow the repeater to drive N LEDs with fewer than N control lines 205, 210. This LED array 200 and repeater structure 300 are much simpler, much easier to implement, and, for relatively small LED arrays, less costly than previous solutions.

The depicted LED array 200, which in many cases is a portion of a larger LED array, includes three LEDs 202, 204, 206 connected between a power supply (e.g., +3.3 volts) and ground. Three optional resistors 208, 210, 212 are included in the array 200 to limit the amount of current drawn through the LEDs. The resistance values of the resistors 208, 210, 212 depend upon several application-specific factors, including the power supply voltage and the desired maximum current draw. Resistance values on the order of 270 Ω are typical when the depicted LED array 200 is used in a 5.0 volt system, and resistance values on the order of 120 Ω are typical when the array is used in a 3.3 volt system. The power supply voltage and the number of LEDs in the array 200 also vary among applications, but in general these features are selected to ensure that the voltage drop across each LED is not large enough to cause the LED to conduct. In this example, each of the three LEDs 202, 204, 206 has a cut-in voltage of approximately 1.5 volts, so a power supply of 3.3 volts will not cause any of the diodes to conduct absent input from the control lines 205, 210.

Larger arrays are constructed by replicating the structure of FIG. 2. For example, the LED array 200 is replicated five times to create a 6×3 array. Only 12 control lines are needed to drive the 18 LEDs in the 6×3 array.

The control lines 205, 210 from the repeater chip 300 connect between adjacent LEDs in the LED array 200. For example, one of the control lines 205 connects between the first LED 202 and the second LED 204; the other control line 210 connects between the second LED 204 and the third LED 206. If the LED array includes the optional resistors 208, 210, 212, each of the control lines connects to the cathode of one of the LEDs 202, 204, 206 and to one of the resistors 208, 210, 212.

The repeater chip 300 includes a conventional repeater logic circuit 302 coupled to a logic block 304 that controls the operation of the LED array 200. The array control logic 304 in turn is coupled to a pair of "tristatable" sink/source buffers 306, 308, each of which drives one of the control lines 205, 210. These "tristatable" sink/source buffers 306, 308 are configured to provide three alternative types of output: (1) a logic high value (e.g., +3.3 volts); (2) a logic low value (e.g., 0.0 volts); and (3) a high impedance output. In general, each sink/source buffer sources current to the LED array when providing a logic high output, sinks current when providing a logic low output, and neither sinks nor sources current when providing a high impedance output.

The array control logic 304 and the sink/source buffers 306, 308 operate as shown in the table of FIG. 4. None of the LEDs illuminate when both of the sink/source buffers 306, 308 provide high impedance outputs. When only the first LED 202 is to illuminate, the first buffer 306 places a low logic output on the first control line 205 and the second buffer 308 places a high impedance output on the second control line 210 [output state (0, Z)]. This forces a voltage of approximately 3.3 volts across the first LED 202, which causes the first LED 202 to conduct. The current in the first LED 202 flows from the power supply to the first sink/source buffer 306. The high impedance output provided by the second buffer 308 insures that the second and third LEDs 204, 206 do not conduct and therefore do no illuminate.

When only the second LED 204 is to illuminate, the first buffer 306 outputs a high logic value and the second buffer 308 outputs a low logic value [output state (1, 0)]. This forces a voltage of approximately 3.3 volts across the second LED 204 and voltages of approximately 0.0 volts across the first and third LEDs 202, 206. In this state, the first buffer 306 sources current to the second LED 204, and the second buffer 308 sinks this current. The first and third LEDs 202, 206 do not conduct.

When only the third LED 206 is to illuminate, the first buffer 306 provides a high impedance output and the second buffer 308 provides a high logic output [output state (Z, 1)]. This forces a voltage of approximately 3.3 volts across the third LED 206 and a voltage of approximately 0.0 volts across the first and second LEDs 202, 204. In this state, the second buffer 308 sources current through the third LED 206 to ground. The first and second LEDs 202, 204 do not conduct.

The repeater usually cycles through the various states, starting with the state in which only the first LED 202 illuminates, then shifting to the states in which only the second LED 204 and only the third LED 206 illuminate. In general, the repeater chip 300 drives the control lines 205, 210 at a relatively fast rate and drives the LEDs with high bursts of intensity, so that an illuminated LED appears to illuminate continuously to the human eye.

In some embodiments, the repeater chip 300 drives two LEDs at a time by cycling through states that otherwise would be unused. For example, the output state (Z, 0) forces voltages of approximately 1.65 volts across the first and second LEDs 202, 204, causing them to conduct. The third LED 208 does not conduct in this state. Likewise, the output states (0, 1) and (1, Z) cause the first and third LEDs 202, 206 and the second and third LEDs 204, 206 to illuminate, respectively. In most cases, these states are used only to convey special information, such as at reset to show that the LEDs and control circuitry are functioning properly.

A number of embodiments of the present invention have been described. Nevertheless, it will be understood that various modifications are possible without departing from the spirit and scope of the invention. For example, in some cases the LED array 200 includes more than three LEDs driven by more than two lines from the repeater chip. The LED array may even include as few as two LEDs driven by one line from the repeater chip if a sufficiently low supply voltage (e.g., approximately 2.8 volts or less) is present. Also, while the invention has been described in terms of a 3.3 volt power supply, some implementations use power sources greater than 3.3 volts. Other implementations use more than one power source, such as a high voltage source of 1.5 volts and a low voltage source of −1.5 volts. Some implementations use negative logic components that operate between ground and a negative voltage source, such as a −3.3 volt source. Accordingly, other embodiments are within the scope of the following claims.

What is claimed is:

1. A circuit for use in providing status information from an electronic signaling system, the circuit comprising:

an array of N visual indicator devices connected in series between high and low voltage sources, where $N \geqq 2$, and where N is selected so that the potential difference between the voltage sources is less than the sum of the cut-in voltages of the N indicator devices in the array;

M control lines connected to the array of indicator devices to provide signals that cause the indicator devices to conduct, where $N > M \geqq 1$, and where each of the control lines connects between two of the indicator devices in the array; and a control circuit configured to drive the M control lines so that not all of the indicator devices in the array conduct at any given time.

2. The circuit of claim 1, wherein the control circuit is configured to drive the control lines so that the indicator devices conduct one at a time.

3. The circuit of claim 1, wherein the control circuit is configured to drive the control lines so that the indicator devices conduct two at a time.

4. The circuit of claim 1, wherein the control circuit is configured to deliver three alternative outputs over each of the M control lines, including a high logic output, a low logic output, and a high impedance output.

5. The circuit of claim 1, where the control circuit includes one tristatable sink/source buffer for each of the M control lines.

6. The circuit of claim 1, wherein N=3 and M=2.

7. The circuit of claim 6, wherein the potential difference between the voltage sources is approximately 3.3 volts or less.

8. An electronic signaling system comprising:

an array of three visual indicator devices connected in parallel between two lines of a power supply of 3.3 volts or less, where each of the indicator devices has a cut-in voltage that exceeds ⅓ of the power supply voltage;

two control lines, each connecting to the array between two of the indicator devices in the array; and a control circuit configured to provide, alternatively, a high logic output, a low logic output, and a high impedance output to each of the lines so that at least one of the indicator devices conducts at least some of the time and so that the three indicator devices do not all conduct at the same time.

9. The system of claim 8, wherein the control circuit is configured to drive the control lines so that only one indicator device conducts at a time.

10. The system of claim 8, wherein the control circuit is configured to drive the control lines so that two indicator devices conduct at a time.

11. A method for use in providing status information from an electronic signaling system to an array of N light emitting diodes (LEDs) connected in series between high and low voltage sources, where $N \geqq 2$, and where N is selected so that the potential difference between the voltage sources is less than the sum of the cut-in voltages of the N LEDs in the array, the method comprising:

delivering control signals from the electronic signaling system to the LED array over M control lines, each connected between two of the LEDs in the array, to cause the LEDs to conduct, where $N>M \geqq 1$; and timing the control signals so that not all of the LEDs in the array conduct at any given time.

12. The method of claim 11, wherein the control signals are timed so that the LEDs conduct one at a time.

13. The method of claim 11, wherein the control signals are timed so that the LEDs conduct two at a time.

14. The method of claim 11, wherein delivering control signals includes delivering three alternative outputs over each of the M control lines, including a high logic output, a low logic output, and a high impedance output.

15. The method of claim 11, wherein N=3 and M=2.

16. The method of claim 15, wherein the potential difference between the voltage sources is approximately 3.3 volts or less.

* * * * *